United States Patent [19]

Schuller et al.

[11] 4,322,041

[45] Mar. 30, 1982

[54] METHOD OF AND APPARATUS FOR WINDING ROVING PACKAGES

[75] Inventors: Marius C. Schuller, Guelph; Leslie J. Harris, Waterloo, both of Canada

[73] Assignee: Fiberglas Canada Inc., Toronto, Canada

[21] Appl. No.: 114,394

[22] Filed: Jan. 22, 1980

[30] Foreign Application Priority Data

Sep. 26, 1979 [CA] Canada ..... 366379

[51] Int. Cl.[3] ..... B65H 54/00; B65H 54/28; B65H 57/28

[52] U.S. Cl. ..... 242/42; 65/11.1; 242/18 G; 242/157 R

[58] Field of Search ..... 242/42, 18 G, 18 R, 242/43 R, 157 R, 7.21, 7.22, 7.23; 65/11 W

[56] References Cited

U.S. PATENT DOCUMENTS

| | | | |
|---|---|---|---|
| 2,345,544 | 3/1974 | Worthington | 242/42 |
| 3,056,711 | 10/1962 | Frickert | 242/18 G X |
| 3,245,624 | 4/1966 | Meyers et al. | 242/157 R X |
| 3,254,978 | 6/1966 | Hayes | 242/42 X |
| 3,301,505 | 1/1967 | McLarty | 242/157 R |
| 3,363,849 | 1/1968 | McLarty | 242/7.21 |
| 3,371,877 | 3/1968 | Klink et al. | 242/18 G |
| 3,438,587 | 4/1969 | Jackson, Jr. | 242/42 |
| 3,777,470 | 12/1973 | Suzuki et al. | 242/42 |
| 4,130,248 | 12/1978 | Hendrix et al. | 242/18 G |

*Primary Examiner*—Stanley N. Gilreath
*Attorney, Agent, or Firm*—Fleit & Jacobson

[57] ABSTRACT

An apparatus and method for winding a multistrand roving package by guiding a plurality of strands along convergent paths of travel towards a winding mandrel employ a pair of spaced strand guide members in the vicinity of the mandrel. The guide members define a gap for the strands and are reciprocated parallel to the mandrel axis so as to alternately engage and deflect the strands into a side-by-side relationship in the package. The strand guide members each have strand guide edge portions so located that, transversely of the mandrel axis, they are offset towards the mandrel from a linearly disposed relationship to intersect the strand paths at different respective angles corresponding to the differences in direction of the strand paths, thereby to compensate for differences in the strand deflections resulting from the differences in direction of the strand paths and to improve the strand deposition.

31 Claims, 20 Drawing Figures

METHOD OF AND APPARATUS FOR WINDING ROVING PACKAGES

THE FIELD OF THE INVENTION

The present invention relates to methods of and apparatus for winding multistrand roving packages and is useful particularly, but not exclusively, for the packaging of strands of glass fibre material.

BACKGROUND OF THE INVENTION

At the present time, multistrand roving packages of glass fibres are conventionally wound in a secondary winding operation.

That is to say, sliver packages are firstly spirally wound in a conventional manner by drawing a multiplicity of glass filaments, from a former containing molten glass and past an applicator for applying size or coating material, with the filaments split into e.g. four strands.

In the secondary winding operation, a plurality of such sliver packages are creeled and roven together through a single guide eye to form a multistrand roving package.

It has now become particularly desirable, for economic reasons, to be able to wind multistrand roving packages from the strands as soon as the latter have been produced, i.e. in a single winding operation directly following the filament forming instead of in the secondary winding mentioned above.

Furthermore, it is desirable to be able to wind a larger number of strands into a multistrand roving package than has been possible hitherto.

Moreover, whether or not the multistrand roving package is wound directly or in a secondary winding operation, it has been found that there is a distinct need to improve over prior multistrand winding methods by providing greater precision of the winding and thus better defined package edges and split efficiency than has been possible hitherto. As will be known to those well versed in the art, the split efficiency is the ratio of the number of splits or strands obtained on unwinding a multistrand package to the number of splits or strands which were originally wound into the package.

DESCRIPTION OF THE PRIOR ART

Various methods and apparatuses have been proposed in the past for winding multistrand packages. Most of these prior art arrangements employ guide elements which are located at a considerable distance from the package build and a conventional wire beater or similar strand traversing mechanism, which results in a package without a well defined edge. This is because the varying and generally increasing tension resulting from increases in the package diameter causes the beater to produce transverse motions in the strand array which are not entirely predictable and which generally decrease in transverse direction and produce the well-known feather-edge build. This package build has the most undesirable effect of containing groups of strands in which one strand of any array is wrapped on a substantially larger or smaller diameter of the package than another strand in the same array, which results, upon unwinding of the array, in different developed lengths within the array, commonly known as catenaries, which are detrimental in subsequent operations, since the greater lengths of the longest strands of the array cause looping and snarling. Moreover, feather edges are easily damaged in subsequent handling.

Furthermore, the feather-edge build has a larger diameter at its centre than at its opposite ends and, as this larger diameter increases, it eventually touches the traversing mechanism. This can be counteracted by withdrawing the traversing mechanism by a complicated and therefore undesirable retracting mechanism, but eventually a package shape approaching a spherical shape will be reached, which is not acceptable since there is a limit to the possible variation in package diameters which can, in practice, be utilized without causing unacceptable catenaries on unwinding of the packages and without the packages occupying too much space during storage and transportation.

In U.S. Pat. No. 4,130,248, issued Dec. 19, 1978 to Hendricks et al., there is disclosed a method and apparatus for packaging multistrand roving in which a traverse mechanism located in close proximity to the package build is employed for guiding a plurality of strands onto a package.

This traverse mechanism comprises a traverse member which is mounted for reciprocation along the package by means of a cylindrical traversing cam of conventional type. A strand guide member extends upwardly from the traverse member for guiding the strands towards the package, the strand guide member being formed with a slot through which the strands pass, and the strands being tangential to the surface of the package but engaging the surface of the package at respective spaced peripheral regions.

In this prior art arrangement, the strand guide member comprises two parallel, guide edges defining the slot, the slot edges alternately engaging the strands as the strand guide member is reciprocated.

This has the result that the strands, which travel along convergent paths to the guide member and are therefore, at any given moment, incident upon one of the straight slot edges at different respective angles, are laterally deflected by that slot edge through different respective angles.

Consequently, although the paths of the strands are equi-angularly spaced before the strands reach the guide member, they are no longer equiangularly spaced after leaving the strand guide member and upon arrival at the package surface. Furthermore, the free lengths of the strands, i.e. the distances between the points at which the strands contact the slot edge and the points at which they meet the package, are such as to give an insufficiently predictable deposition of the strands in the package. The result of this is that the strands are not deposited in uniformly peripherally and axially spaced relationship on the strand package.

OBJECTS OF THE INVENTION

It is accordingly an object of the present invention to provide a novel and improved multistrand roving winding apparatus and method which provides greater precision and uniformity than has been possible hitherto in the deposition in the plurality of strands in side-by-side relation on a package.

It is a further object of the present invention to increase the number of strands which can be simultaneously wound into a multistrand package.

It is a still further object of the present invention to enable conventional strand winding machinery to be readily adapted, by the use of a novel strand guide, to the production of multistrand packages.

SUMMARY OF THE INVENTION

The present invention proceeds from the realization that when a strand is guided by a strand guide edge extending at an angle to the path of the strand, the strand path is deflected by the strand guide edge through an amount which depends on the angle of incidence of the strand upon the strand guide edge. Consequently, when a plurality of convergent strands are incident at different angles on a common linear strand guide edge, they are deflected through different angles by the strand guide edge and consequently the strands are correspondingly non-uniformly deposited in the package. Moreover, the lack of uniformity is aggravated by the reciprocation of the array of the strands which is inherent in this winding method.

The present invention proposes to shape a strand guide edge so that a plurality of convergent strands engage edge portions of the guide member which are angled so as to compensate for the different angles at which the strands meet the strand guide edge.

More particularly, according to the present invention there is provided apparatus for winding a multistrand roving package, comprising a winding mandrel; means for guiding a plurality of strands along convergent paths of travel towards the winding mandrel; a pair of spaced strand guides in the vicinity of the winding mandrel; the guides defining a gap therebetween for receiving the strands; means for rotating the winding mandrel about the longitudinal axis thereof to wind the strands into a package thereon; means for reciprocating the strand guides parallel to the winding mandrel axis so that the strand guides alternately engage the strands and thereby deflect the strands from the strand paths and control deposition of the strands in such a way as to result in the strands having a side-by-side relationship in the package after their deposition; the strand guides each comprising a guide edge having a plurality of guide edge portions for contacting respective ones of the strands; and the guide edge portions being so located that, transversely of the winding mandrel axis, the guide edge portions are offset towards the winding mandrel from a linearly disposed relationship to intersect the strand paths at different respective angles corresponding to the differences in direction of said strand paths and thereby to compensate for differences in the deflections of the strands by the guides resulting from the differences in direction of the strand paths and improve the deposition of the strands into the package.

The present invention further provides, in a method of packaging a multistrand roving which includes rotating a winding mandrel about the longitudinal axis thereof to wind a plurality of strands into a package on the mandrel; guiding the strands along respective convergent paths of travel towards the winding mandrel; passing the strands between a pair of spaced strand guides in the vicinity of the winding mandrel; and reciprocating the strand guides parallel to the axis so that the strand guides alternately engage and deflect the strands from the paths for controlling deposition of the strands into the package; the improvement comprising the step of contacting the strands by respective guide edge portions of the strand guides so located that, transversely of the winding mandrel axis the guide edge portions are offset towards the winding mandrel from a linearly disposed relationship to intersect the strand paths at different respective angles corresponding to the differences in direction of the strand paths and thereby to compensate for differences in the deflections of the strands by the guides resulting from the differences in direction of the strand paths and improve the deposition of the strands into the package.

The present multistrand winding method and apparatus may be employed for secondary winding but are particularly advantageous for winding strands from filaments as the filaments are formed.

BRIEF DESCRIPTION OF THE DRAWINGS

The invention will be more readily understood from the following description of a preferred embodiment thereof given, by way of example, with reference to the accompanying drawings, in which.

DESCRIPTION OF PREFERRED EMBODIMENT

Figure 2:
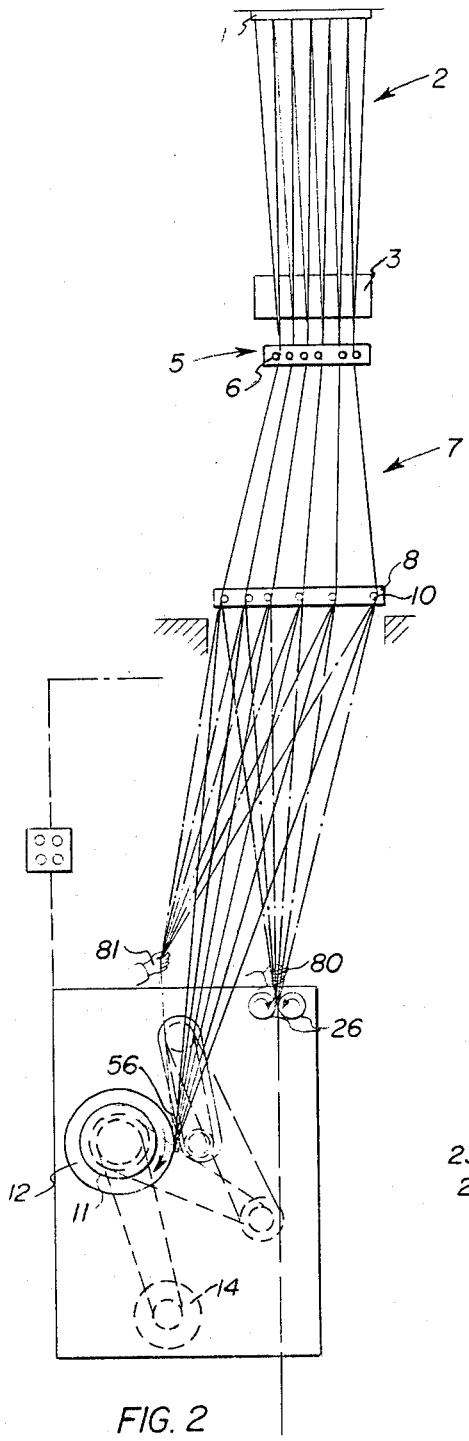
FIG. 2 is a view taken in front elevation of the apparatus shown in FIG. 1.

The embodiment of the invention illustrated in the drawings, as described in greater detail hereinafter, is particularly intended for forming multistrand roving packages from strands of glass fibre. However, it is particularly pointed out that the invention is not restricted to use with glass fibre, but may be employed for packaging roving of other fibrous materials.

Figure 1:
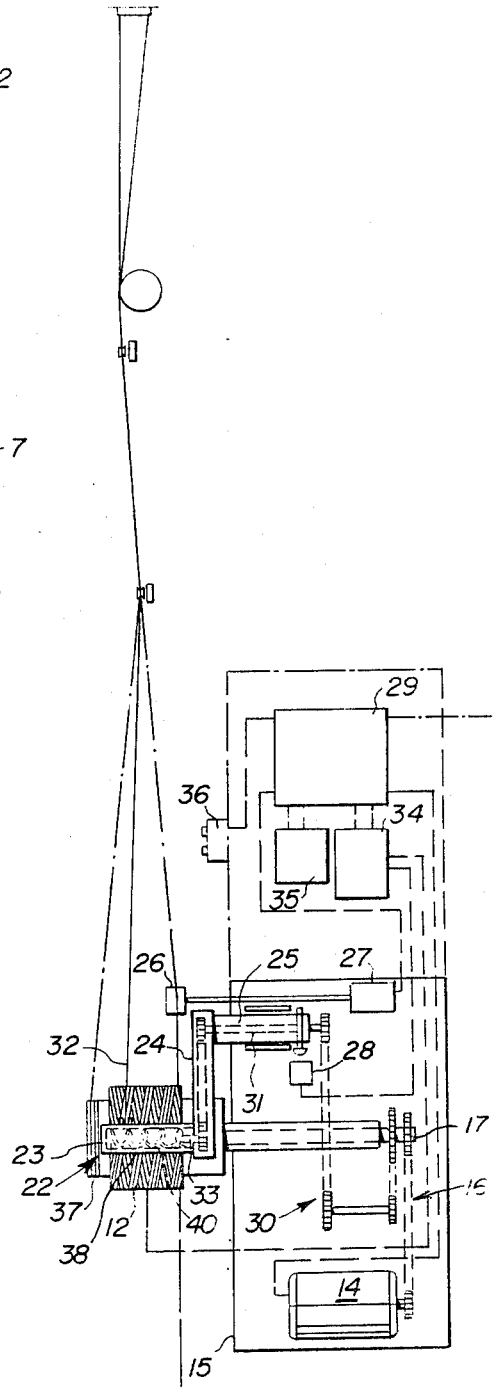
FIG. 1 is a view taken in side elevation of apparatus for forming and winding a multistrand roving package.

Referring now to FIGS. 1 and 2 of the drawings, the apparatus illustrated therein comprises a feeder or bushing 1 containing molten glass, which flows through orifices in the underside of the feeder 1 and is attenuated to form multiple glass fibre filaments indicated generally by reference numeral 2.

As will be readily apparent to those skilled in the art, the feeder 1 may be connected to a forehearth (not shown) to which molten glass flows from a furnace, and the feeder 1 is of conventional and therefore commonly known construction and is accordingly not described in greater detail.

From the feeder 1, the multiple filaments 2 are drawn downwardly past an applicator roller 3 at which a coating material, for example size, is applied to the filaments 2.

From the application roller 3, the filaments pass further downwardly to an upper splitter bar, indicated generally by reference material 5, which comprises a plurality of gathering shoes or guide rollers 6.

The gathering shoes 6 gather the filaments 2 together in groups to form them into strands, which are indicated generally by reference numeral 7.

In the present case, six strands 7 are shown for convenience of illustration. However, it is at this point mentioned that the present invention is by no means restricted to operation with six strands, but is particularly useful for simultaneously winding a greater number of strands, e.g. sixteen strands or even more.

From the splitter 5, the strands 7 travel downwardly along divergent paths to a lower splitter bar 8 comprising a plurality of strand guides 10, from which the strands 7 travel further downwardly, along downwardly convergent paths of travel, to a winding collet or mandrel 11, on which the strands 7 are wound to form a multistrand roving package 12.

An electric motor 14, mounted within a housing 15, is connected to the winding mandrel 11 through a power transmission 16 and a drive shaft 17 for rotating the mandrel 11.

During the winding of the package 12, the strands 7 are reciprocated to and fro along the package 12 by means of a traversing mechanism indicated generally by reference numeral 22.

The traversing mechanism 22 comprises a tubular housing 23 which extends horizontally and parallel to the axis of rotation of the winding mandrel 11 and the package 12.

The tubular housing 23 is carried at the lower end of a hollow arm 24, the upper end of which has a hollow end portion 25 journalled within the housing 15.

By rotation of the hollow arm 24 and the tubular housing 23 about the axis of the hollow end portion 25 of the hollow arm 24, the guide mechanism illustrated in FIG. 3, which is mounted as described in greater detail hereinafter on the tubular housing 23, is incrementally pivoted away from the axis of the winding mandrel 17 as the diameter of the package 12 increases.

For this purpose, the hollow portion 25 is connected to a package build-up compensator 28.

The motor 14 is also connected through the shaft 17 and a power transmission 30 to a shaft 31 extending through the hollow portion 25 and a further power transmission 32 to a cam shaft 33, on which is mounted a traverse cam 37.

The traverse cam 37 is of cylindrical shape and provided with a multiple return groove 40 (FIG. 3), in which is engaged a cam follower 41 and a cross-over guide 41*a*.

The cam follower 41 projects from a slide block 42 which is provided, at opposite sides thereof, with a pair of grooves 43 in sliding engagement with opposite straight guide edge portions 44 of guide plates 45, which are secured to the tubular housing 23.

The cross-over guide 41*a* is pivotable relative to the cam follower 41 and engages in a cross-over guide groove 40*a* at the bottom of the groove 40 to ensure that the cam follower 41 does not change direction as it passes through the cross-over points in the groove 40.

As the traverse cam 37 is rotated about its longitudinal axis by the electric motor 14, the cam follower 41, and therewith the slide block 42, are reciprocated or traversed along the tubular housing 23 and thus parallel to the longitudinal axis, or the axis of rotation, of the winding mandrel 11.

A pair of pull rolls 26 are driven by an electric motor 27 and the energization of the motors 27 and 14 and the package build-up compensator 28 are controlled by a motor power and speed control programmer 29, a build-up control unit 34 and a timer 35 in response to actuation of an on-off switch 36 and a reed switch 38.

It will be understood by those skilled in the art that the traversing mechanism, as hereinbefore described, is well known in the art.

Figure 3:
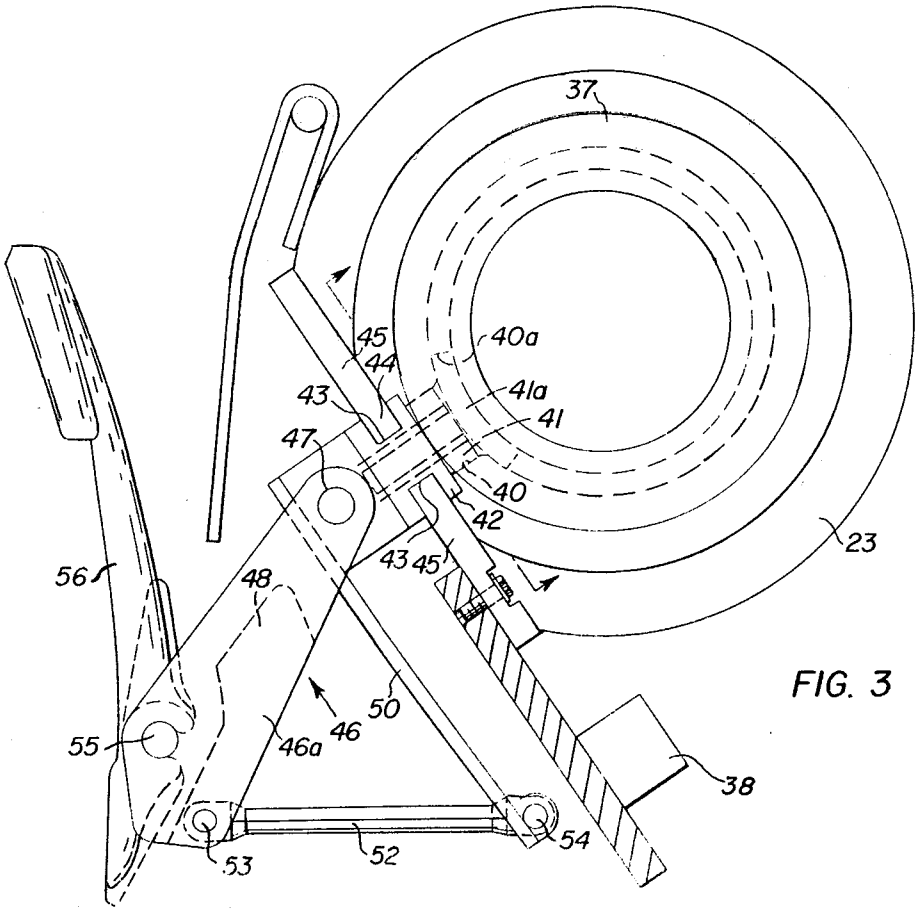
FIG. 3 shows a view taken in cross-section through a traversing cam of the cam and a guide mechanism operated thereby and forming part of the apparatus of FIGS. 1 and 2.

The slide block 42 carries a pivotal support, indicated generally by reference numeral 46, which comprises a pair of side arms 46*a*, of which only one is visible in FIG. 3, extending from opposite sides of the slide block 42 and pivotally secured at their upper ends to the slide block 42 by means of a pivot 47, which may take the form of any suitable pivot pin or sleeve.

The side arms 46*a* of the support 46 are connected together by a bridge portion 48 extending between the side arms 46*a* and integral therewith.

A leaf spring 50 is attached to and extends from the slide block 42.

The lowermost ends of the arms 46*a* of the support 46 are connected by a common link rod 52 to the lowermost end of the leaf spring 50.

More particularly, the link rod 52 is pivotally connected to the lowermost ends of the support side arms 46*a* by a pivot pin 53 and to the lowermost end of the leaf spring 50 by a magnetic pivot pin 54.

A strand guide 56 carried by the support 46 and extending from between the side walls 46*a* is pivotally connected to the side walls 46*a* by means of a pivot 55.

Figure 4A:
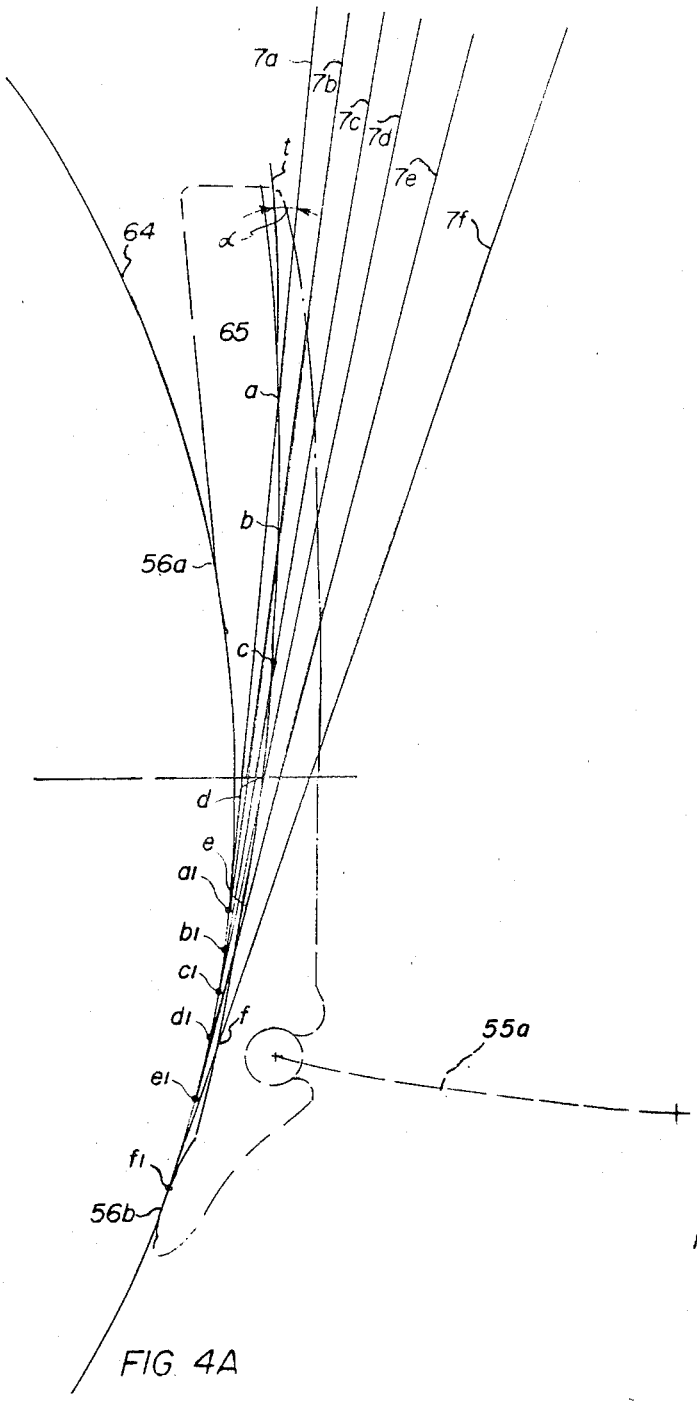
FIGS. 4*a* and 4*b* show diagrams illustrating the paths of a plurality of convergent strands extending past a strand guide edge and onto the periphery of a multistrand package, as viewed parallel to the axis of the package.
Figure 4B:
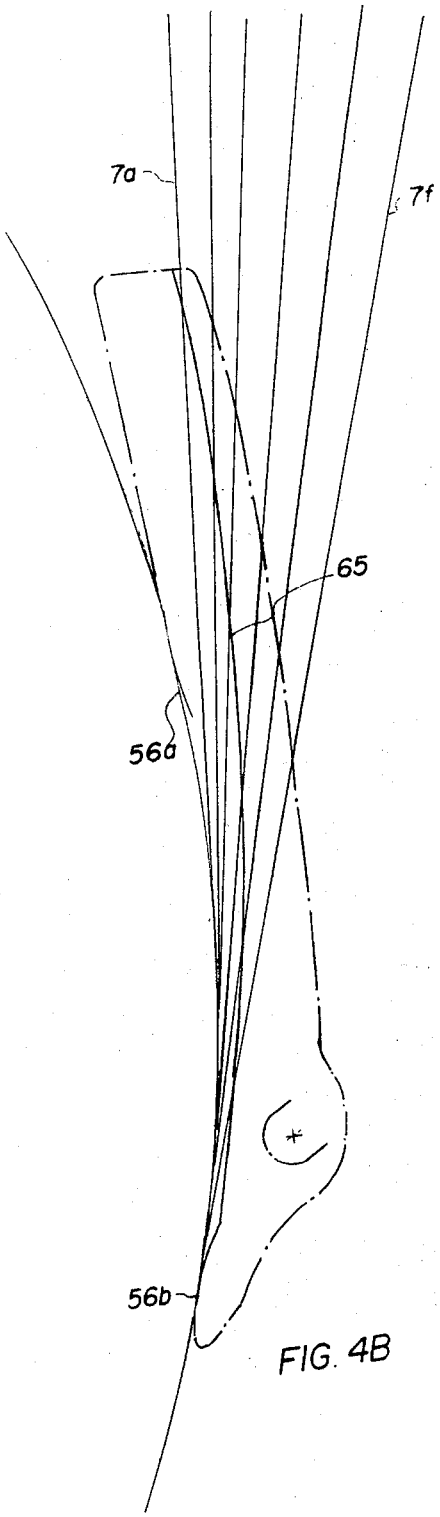
Figure 10:
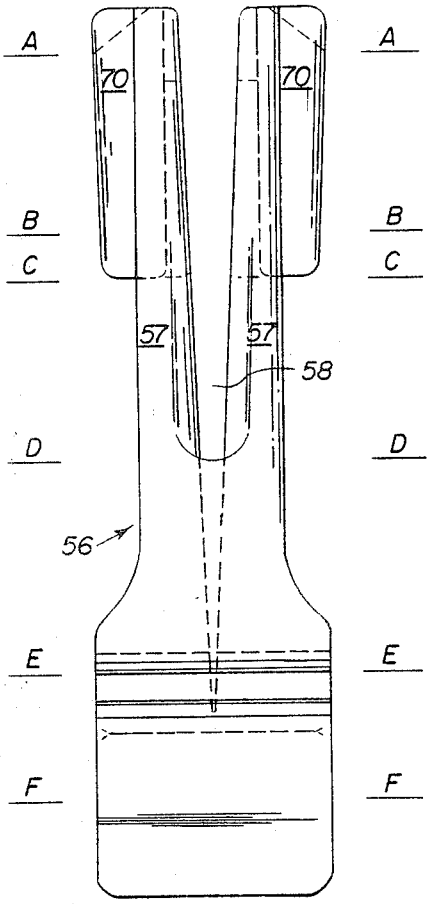
FIGS. 10 and 11 show, respectively, a front view and a side view of the strand guide of FIG. 9.
Figure 11:
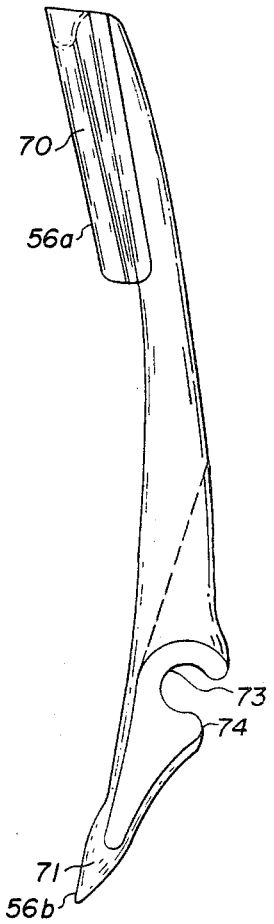
Figure 12:
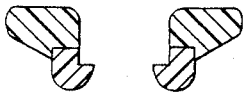
FIGS. 12 through 17 show views taken in cross-section along the lines A—A through F—F, respectively, of FIG. 10.
Figure 13:
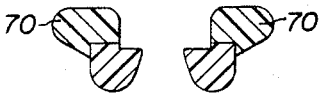
Figure 14:
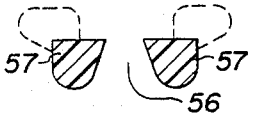
Figure 15:
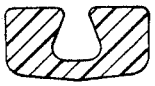
Figure 16:
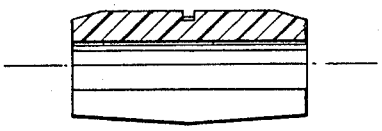
Figure 17:
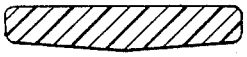

The shape and functioning of the strand guide 56 are described in greater detail hereinafter and, for the present, it is mentioned that the strand guide 56 comprises, as illustrated in FIG. 10, a pair of upstanding forked fingers 57 defining a gap 58 therebetween, and that the strands 7 travel between the fingers 57 through the gap 58 to the peripheral surface of the package 12, as shown in FIGS. 4*a* and 4*b*, and are alternately engaged by the fingers 57 as the strand guide 56 is traversed to and fro parallel to the winding mandrel axis by the traverse cam 37.

As the diameter of the package 12 increases and the periphery of the package 12 presses against the guide member 56, the support 46 is pivoted in an anti-clockwise direction, as viewed in FIG. 3, about the pivot 47, against the action of the leaf spring 50 until the lowermost end of the leaf spring 50 actuates the reed switch 38. This causes the traverse arm 24 to be pivotally stepped to the right, as viewed in FIG. 2, sufficiently to relax the spring 50. The tubular housing 23, and therewith the strand guide 56, are thus moved further away from the axis of the winding mandrel 11 as the package diameter increases.

The means by which the strands 7 are guided onto the periphery of the package 12 will now be described with reference to FIGS. 4*a*, 4*b* and 5*a*, 5*b*.

Referring firstly to FIG. 4*a*, reference numeral 64 indicates the periphery of the package 12.

A line indicated by reference numeral 65 represents a curved guide edge, viewed in a direction parallel to the axis of the package 12, of one of the fingers 57 of the strand guide 56 in contact with the strands 7 at points a–f on respective portions of the guide edge 65, which points are spaced apart along the guide edge 65.

As the strands 7 pass over the guide edge 65, they are each slightly deflected by their engagement with the guide edge 65 and the amounts of such deflections correspond to the respective angles at which the strands 7 meet the guide edge 65.

If the finger 57 and the guide edge 65 were straight, the convergent strands 7 would intersect the guide edge 65 at different angles, and would therefore be deflected by different amounts by the finger 57.

Consequently, as the strands 7 are equi-angularly spaced along their paths of travel from the strand guides 10 to the strand guide 56, then the strands would no longer be equi-angularly spaced during their further travel beyond the guide 56 to the periphery 64 of the package, and would therefore be depositioned at peripherally non-uniformly spaced points on the periphery 64 of the package.

However, in the present case the finger 57 and therefore the line 65 are curved so as to compensate for the different angles of approach of the strands 7 by deflecting each of the strands 7 through at least substantially the same angle.

More particularly, the strand guide edge 65 is so curved that, at each of the guide points or portions a–f, the tangent to the line 65 subtends with the path of the respective strand 7 from the splitter bar 8 an angle which is the same for all of the strands 7. Consequently, each of the strands 7 is deflected through the same angle by the guide edge 65.

To facilitate the further description of the strand guidance, the strands meeting the strand guide edge 65 at points a–f have been labelled *7a–7f*, respectively, in FIGS. *4a*, *4b*, and *5a*, *5b*.

The left-hand strand *7a* shown in FIG. *4a*, which intersects the edge 65 at point a, subtends with the tangent t to the line 65 at the point a an angle $\alpha$. The angle $\alpha$ is the same for each of the six strands 7. Furthermore, the left-hand strand *7a* is deflected at the line 65 through an angle of deflection which in practice is approximately 2°, and each of the other strands 7 is likewise deflected at the line 65 through the same angle of deflection.

In this way it is ensured that the strands *7a–7f* are deposited at more uniformly peripherally and axially spaced positions on the periphery 64 of the package.

In connection with the above description, it is to be understood that the tangent t, the angle $\alpha$ and the strand deflection angle, for each of the strands *7a–7f*, are projections onto a respective plane extending transversely of the axis of rotation of the package and the winding mandrel and that there is in fact a three-dimensional relationship between the strands and the guide edge, as will be apparent from the following description.

As can be seen from FIG. 10, the guide fingers 57 are upwardly divergent, and likewise the gap 58 is upwardly divergent. Thus, the guide edge 65 does not lie in a plane transverse to the winding axis, but is at an inclination to such plane, as shown in FIG. *5a*, which shows the guide edge 65 as viewed transversely of the winding axis and which further shows the portions of the strands *7a–7f* extending beyond the guide edge 65 during their travel between the guide edge 65 and the periphery of the package.

The line 66 in FIG. *5a* represents a vertical plane, transverse to the winding axis, bisecting the gap 58.

Thus it will be apparent that the guide edge 65 is curved, as viewed axially of the winding mandrel, and also that the guide edge 65 does not lie in a plane perpendicular to the winding mandrel axis but as viewed in a direction perpendicular to the winding mandrel axis, i.e. as shown in FIGS. *5a*, *5b* and 10, the guide edges 65 of the two fingers 57 of the strand guide 56 are downwardly convergent, i.e. the gap 58 is an upwardly-open, Vee-shaped gap.

The shapes of the two guide edges 65 are shown in FIG. *6a*, and the points at which the strands 7 meet the package periphery are indicated at a1–f1. As is apparent in FIG. *6a*, the points a1–f1 are spaced both longitudinally and peripherally on the package.

For greater clarification, the path of a single one of the strands is shown in FIG. *6b*. More particularly, FIG. *6b* shows the strand *7a* which contacts one of the guide edges 65 at point a and is deposited onto the package build at point a1.

The path of the strand between points a and a1, as projected onto a vertial plane parallel to the build face, is represented by line a–a11, the same path as projected onto a horizontal plane parallel to the build face is represented by line a1–a11.

The angle a11 a a111 is the helix angle $\beta$, also shown on the build face, at which the strand is wound onto the package build.

Referring again to FIG. *5a*, it will be seen that the strands 7 are deposited on the package across a deposition width D.

In fact, FIGS. *4a* and *5a* show the strands 7 and the strand guide 57 in the positions which they assume at the beginning of the winding of the package.

As the package diameter increases during the winding of the strands, the helix angle consequently decreases as is well known to those skilled in the art, and, for the reason described hereinafter, the points a–f at which the strands 7 contact the guide edge 65 are displaced upwardly along the guide edge 65 as shown in FIGS. *4b* and *5b*, which illustrate the positions of the strands 7 and the strand guide 57 at the end of the winding of the package.

However, because of the change in elevation and to a smaller degree, the inclination of the strand guide edge as viewed transversely of the winding mandrel axis and shown in FIGS. *5a* and *5b*, the deposition width D does not alter in accordance with the alteration of the helix angle but in fact remains approximately constant, as will be explained below.

FIGS. *4a* and *4b* also show surface portions *56a* and *56b* of the strand guide 56 at which the latter contacts the package build. These surface portions *56a* and *56b*, being in a fixed spatial relationship to the two strand guide edges 65, determine the position of the strand guide 56 at all times relative to the package build. As the package build increases, the contact of the surface portions *56a*, *56b* with the periphery of the package build causes the strand guide 56 to pivot anticlockwise, as viewed in FIG. *4a*, about the pivot 55.

Also, as the package build increases to pivot support 46 about pivot 47, the path of the axis of the pivot 55 of the strand guide 56 as the package diameter increases between the start and end of the winding is shown by broken line *55a* which, in the present case, is an upwardly concave, downwardly inclined curve. However, the axis of pivot 55 may, in other embodiments, follow paths of various other shapes.

Thus, the strand guide 56 is lowered slightly as the package build diameter increases, and it is this lowering of the strand guide which causes the points a–f to be displaced upwardly along the strand guide edge 65 as mentioned hereinabove.

As will be apparent, this displacement of the points a–f along the guide edge 65 has the further advantage of distributing along the guide edge 65 the wear of the latter by the strands *7a–7f*.

It should also be mentioned that a further advantage of the use of the Vee-shaped gap 58 defined by the two guide edges 65 is that the height of the strand guides is substantially reduced in comparison with a strand guide having a strand gap defined by parallel strand guide edges.

Figure 5A:
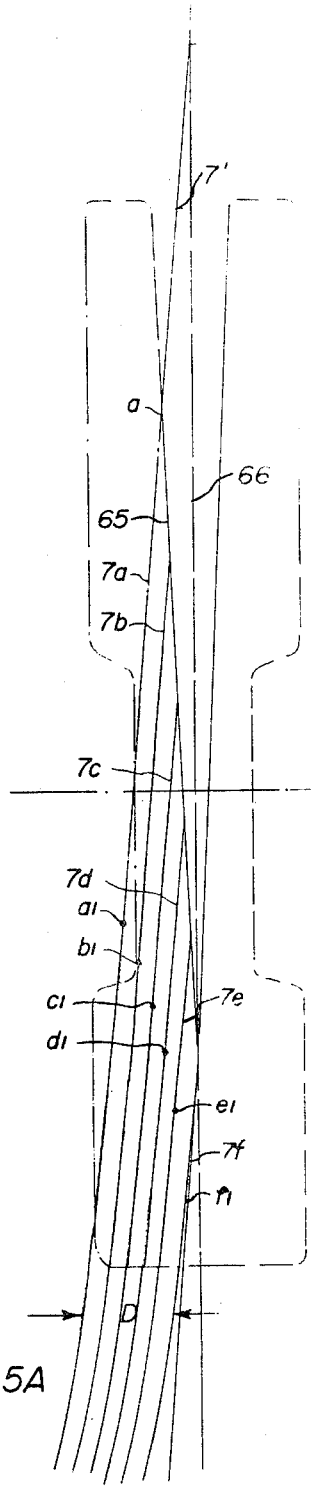
FIGS. 5*a* and 5*b* show views taken transversely of the axis of the package and illustrating the axial deflections of the strands of FIGS. 4*a* and 4*b;*

Thus, referring to FIG. 5*a*, and assuming that vertical broken line 66 represents the position of an imaginary guide edge of a straight strand guide gap, and broken line 7′ represents the path which would be followed by the left-hand strand *7a* if it were guided onto the package at the same angle but by the edge 66 instead of the edge 65. It is apparent that the point a would be displaced upwardly to the intersection of line *7a* and the edge 65*a*.

Figure 5B:
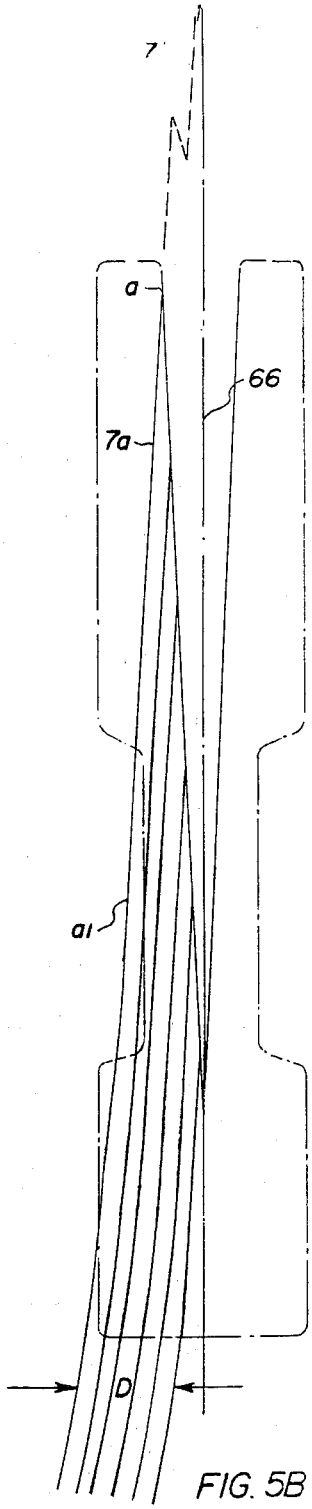
Figure 6A:
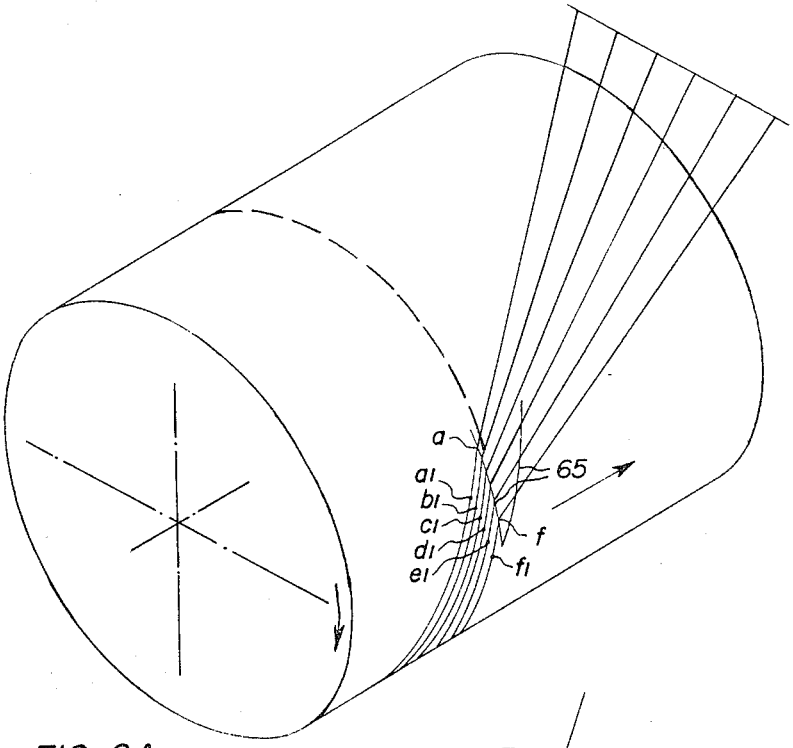
FIGS. 6*a* and 6*b* are diagrammatic views in perspective showing the deposition of the strands into the package.
Figure 6B:
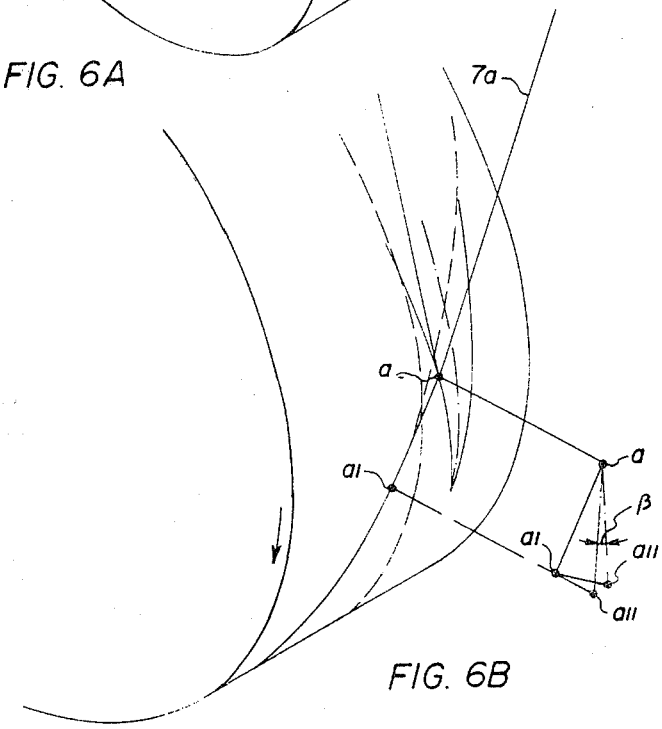

In fact, such upward displacement of the point a would be very considerably greater at the end of the winding, as diagrammatically shown in FIG. 5*b*, in which line 7′ has been interrupted to reduce the height of the illustration.

Figure 7:
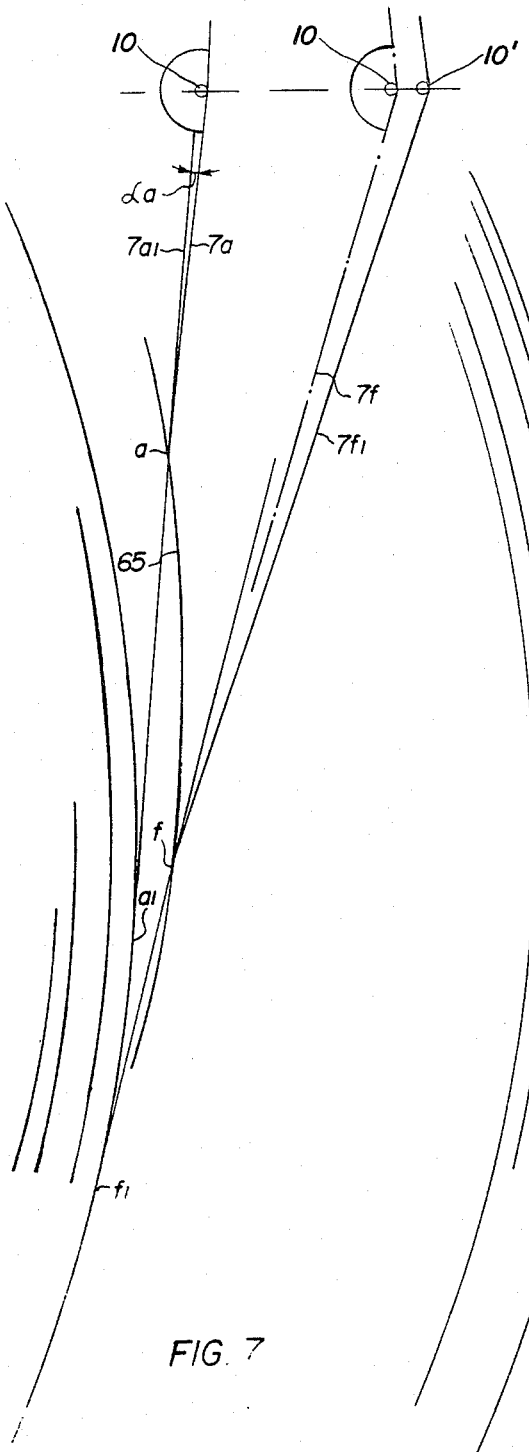
FIGS. 7 and 8 show diagrammatic views of two different arrangements for compensating for tension differences in the strands.

Referring now to FIG. 7, in which the extreme left- and right-hand strands *7a* and *7f* are shown, the line 7a1 shows an imaginary upward extension of the path of the strand *7a* between the points a and a1. Thus, the angle $\alpha_a$ represents the angle of deflection (viewed parallel to the winding axis) of the strand *7a* by the strand guide edge 65.

As explained above, the magnitude of this angle is related to the angle at which the strand meets the strand guide.

In addition, however, the magnitude of the angle of deflection of each of the strands is also affected by the tension in the relevant strand, and the tension in the relevant strand is in turn affected by the angle of wrap of the strand around its strand guide 10.

As will be apparent from FIG. 7, the angle of wrap of the strand *7f* around its strand guide 10 is considerably greater than that of the strand *7a* around its strand guide 10.

Consequently, the tension in the strand *7f* is greater than that in the strand *7a*.

If this tension difference is ignored, the angle of deflection of the strand *7f* at the strand guide edge 65 will be considerably greater than that of the strand *7a* and the strand *7f* will not be deposited into the package build at the desired point of deposition f1 and the accuracy of the deposition will thus be adversely affected.

One way in which this tension difference can be compensated is to offset the strand guide 10 of the strand *7f* to the position shown at 10′, so that the strand *7f* travels to the strand guide edge 65 along a path indicated by reference numeral 7f1 and thus meets the strand guide edge at a modified angle, which alters and corrects the angle of deflection of the strand *7f* at the strand guide edge 65, so that the strand is correctly deposited at point f1.

Figure 8:
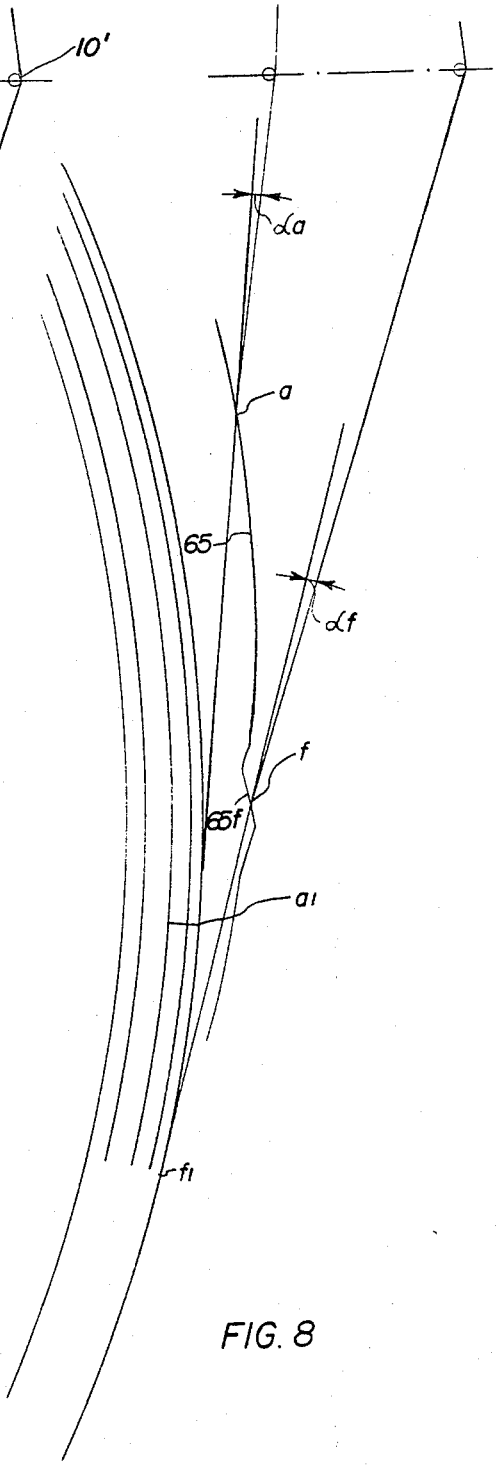
Figure 9:
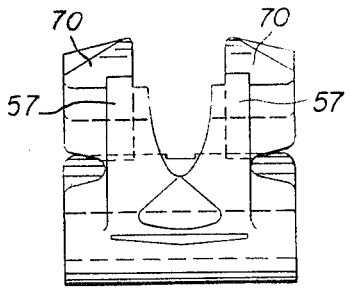
FIG. 9 shows a plan view of a strand guide forming part of the mechanism of FIG. 3.

Another way in which the tension difference between the strands *7a* and *7f* can be compensated, is to modify the shape of the strand guide edge *7f* as illustrated in FIG. 8.

As shown in FIG. 8, the shape of the strand guide edge 65 includes a modified guide edge portion 65*f* which is angled so as to alter the angle at which the strand *7f* meets the strand guide edge and thus to modify the angle of deflection of the strand *7f* sufficiently to compensate for the additional tension in the strand *7f* and thus to ensure that the strand *7f* is correctly deposited at point f1 on the package build. It will be understood that the modified angle of the guide edge portion 65*f* has been exaggerated in FIG. 8 to clarify the illustration.

Referring now to FIGS. 9 through 17 for a more detailed description of the strand guide, it will be seen that each of the guide fingers 57 is provided, at its upper end, with a forwardly and laterally projecting enlargement 70, on which is formed the surface 56*a* which engages the periphery 64 of the package as the diameter of the package increases during the winding operation, as mentioned above.

The lowermost end of the guide 56 is formed with a forwardly and downwardly extending projection 71, on which is formed the other surface 56*b* which engages the periphery of the package.

The guide 56 is further provided with a cylindrically curved recess 73 for receiving the pivot 55, and the wall of the recess 73 is interrupted, at the rear of the guide 56, by a gap 74 extending the length of the recess 73. The gap 74 enables the guide 56 to be snapped onto and from the pivot 55, the material of the guide 56 being resilient to enable the gaps 74 to be spread apart for this purpose.

This facilitates quick and simple replacement of the guide 56 when required.

In operation of the above-described apparatus, and assuming that the strands are initially passing through the pull-rolls 26 prior to a winding operation, the operator manually gathers and grasps the strands at a position indicated in FIG. 2 by a hand 80.

He then wraps the combined strands around the collet 11 and moves his hand to the starting position, which is represented by hand 81. Then, he places the combined strands into the Vee-shaped gap 58 of the strand guide 56 and releases them, whereupon they assume their running positions as illustrated in FIGS. 1, 2 and 4*a*.

The package is then wound as described above and, when the package build is completed, the above-described handling of the strands is reversed to gather the strands, remove them from the strand guide and feed them between the pull rolls 26.

We claim:

1. Apparatus for winding a multistrand roving package, comprising:

a winding mandrel;

means for guiding a plurality of strands along convergent paths of travel towards said winding mandrel;

a pair of spaced strand guide members in the vicinity of said winding mandrel;

said guide members defining a gap therebetween for receiving said strands;

means for rotating said winding mandrel about the longitudinal axis thereof to wind said strands into a package thereon;

means for reciprocating said strand guide members parallel to said winding mandrel axis so that said strand guide members alternately engage said strands and thereby deflect said strands in such a way as to result in the strands having a side-by-side relationship in said package after the deposition;

said strand guide members each having a plurality of guide edge portions for contacting respective ones of said strands; and said guide edge portions being so located that, transversely of said winding mandrel axis, said guide edge portions are offset towards said winding mandrel from a linearly disposed relationship to intersect said strand paths at different respective angles corresponding to the differences in direction of said strand paths, thereby to compensate for differences in said deflections of said strands by said guide members resulting from the differences in direction of said strand paths and improve said deposition of said strands into said package.

2. Apparatus as claimed in claim 1, wherein, in planes transverse to said winding mandrel axis, tangents to said guide members at said guide portions subtend equal angles with the respective strand paths.

3. Apparatus as claimed in claim 1, wherein said strand guide members are convergent as viewed transversely of said winding mandrel axis.

4. Apparatus as claimed in claim 1, 2 or 3, wherein said guide path directions are so oriented as to compensate for the effects of differences in tension in said strands on the deflection of said strands by said guide portions.

5. Apparatus as claimed in claim 1, 2 or 3, wherein the offsetting of said guide portions towards said mandrel is modified to compensate for the effects of differences in tension in said strands on the deflection of said strands by said guide portions.

6. Apparatus for winding a multistrand roving package, comprising:

a winding mandrel;

means for guiding a plurality of strands along convergent paths of travel towards said winding mandrel;

means for rotating said winding mandrel about the longitudinal axis thereof to wind said strands into a package;

a strand guide mounted in the vicinity of said winding mandrel;

said strand guide comprising a pair of guide fingers spaced apart along said winding mandrel and defining a gap therebetween for receiving said strands;

means for transversing said strand guide to and fro parallel to said winding mandrel axis so that said guide fingers alternately engage said strands and thereby deflect said strands from said strand paths and control deposition of said strands at peripherally spaced points on said package and in such a way as to result in the strands having a side-by-side relationship in said package after the deposition;

said guide fingers being concave towards said winding mandrel axis and each having a plurality of guide edge portions for contacting respective ones of said strands; and said guide edge portions being located so that, transversely of said winding mandrel axis, said guide edge portions are each offset towards said winding mandrel from a linearly disposed relationship to intersect said strand paths at different respective angles corresponding to the differences in direction of said strand paths, and thereby to compensate for differences in said deflections of said strands by said guide fingers resulting from the differences in direction of said strand paths and improve said deposition of said strands into said package.

7. Apparatus as claimed in claim 6, wherein said guide fingers converge longitudinally thereof.

8. Apparatus for forming and packaging a multistrand roving, comprising:

means for forming multiple streams of molten glass;

means for attenuating said streams into continuous filaments;

a winding mandrel;

means for gathering said filaments into a plurality of strands and guiding said strands along convergent paths of travel towards said winding mandrel; p1 means for rotating said winding mandrel about the longitudinal axis thereof to wind said strands into a package;

a strand guide mounted in the vicinity of said winding mandrel;

said strand guide comprising a pair of guide fingers spaced apart along said winding mandrel and having guide edges defining a gap therebetween for receiving said strands;

means for traversing said strand guide to and fro parallel to said winding mandrel axis so that said guide edges alternately engage said strands and thereby deflect said strands from said strand paths and control deposition of said strands at peripherally spaced points on said package and in such a way as to result in the strands having a side-by-side relationship in said package after the deposition;

said guide edges being concave towards said winding mandrel axis and each comprising a plurality of guide edge portions for contacting respective ones of said strands; and said guide edge portions being located so that, transversely of said winding mandrel axis, said guide edge portions are offset towards said winding mandrel from a linearly disposed relationship to intersect said strand paths at different respective angles corresponding to the differences in direction of said strand paths and thereby to compensate for differences in said deflections of said strands by said guide resulting from the differences in direction of said strand paths and improve said deposition of said strands into said package.

9. In a method of packaging a multistrand roving which includes:

rotating a winding mandrel about the longitudinal axis thereof to wind a plurality of strands into a package on said mandrel;

guiding said strands along respective convergent paths of travel towards said winding mandrel;

passing said strands between a pair of spaced strand guide members in the vicinity of said winding mandrel; and reciprocating said strand guide members parallel to said axis so that said strand guide members alternately engage said strands and thereby deflect said strands from said paths for controlling deposition of said strands into said package;

the improvement comprising the step of contacting said strands by respective guide edge portions of said strand guide members so located that, transversely of said winding mandrel axis, said guide edge portions are offset towards said winding mandrel from a linearly disposed relationship to intersect said strand paths at different respective angles corresponding to the differences in direction of said strand paths and thereby to compensate for differences in said deflections of said strands by said guide members resulting from the differences in direction of said strand paths and improve said deposition of said strands into said package.

10. A method as claimed in claim 9, which includes deflecting said strands by said guide edge portions, transversely of said winding mandrel axis, by amounts which at least partly compensate for differences in tension in said strands relative to one another.

11. A method as claimed in claim 9, which includes offsetting said guide edge portions from said linearly disposed relationship by respective predetermined amounts corresponding to differences in tension in said strands relative to one another to compensate for differences in said deflections of said strands by said guide surfaces resulting from said strand tension differences.

12. A method as claimed in claim 9, which includes prearranging the directions of the strand paths in accordance with differences in tension in said strands relative to one another to compensate for differences in said deflections of said strands by said guide members resulting from said strand tension differences.

13. A method as claimed in claim 9, 10 or 11, which includes locating said guide members in mutually divergent relationship.

14. A method as claimed in claim 9, 10 or 11, which includes depositing said strands into said package in side-by-side relationship at respective points of deposition which are spaced both peripherally and longitudinally of said package.

15. A method as claimed in claim 9, which includes, during initiation of the winding of the package, the steps of manually gathering together said strands to combine them, wrapping the combined strands around said winding mandrel, placing said combined strands between said strand guide members and thereafter releasing said strands, whereupon said strands assume respective running positions at said respective guide edge portions.

16. A method as claimed in claim 9, which includes displacing said strand guide, during the winding of the package, to correspondingly displace the strands along guide edges on said strand guide members.

17. A method as claimed in claim 9, in which the guiding of said strands includes guiding said strands at a position remote from said strand guide members and said strands pass free of any guidance between said remote position and said strand guide members.

18. A method of packaging multistrand roving, which comprises the steps of:

rotating a winding mandrel about the longitudinal axis thereof to wind a plurality of strands into a package on said mandrel;

guiding said strands along respective convergent paths of travel towards said winding mandrel;

passing said strands between a pair of strand guide members located in the vicinity of said winding mandrel and spaced apart along said winding mandrel;

reciprocating said guide members parallel to said winding mandrel axis so that said guide members alternately engage said strands and thereby deflect said strands from said strand paths for controlling deposition of said strands into said package; and contacting said strands by guide edge portions of said guide members so located and oriented that, transversely of said winding mandrel axis, tangents to said guide edge portions extend at equal angles to the respective strand paths to compensate for differences in said deflections of said strands by said guide members resulting from the differences in direction of said strand paths, thereby improving said deposition of said strands into said package.

19. A method of producing a multistrand roving package, comprising the steps of:

flowing multiple streams of molten glass from a forming unit;

attenuating said streams into continuous filaments;

gathering and sizing said filaments to form a plurality of strands;

simultaneously guiding said strands along respective paths of travel extending in convergent directions towards a winding mandrel;

rotating said winding mandrel at the longitudinal axis thereof to wind said strands into a package on said winding mandrel;

passing said strands between a pair of spaced guide members in the vicinity of said winding mandrel;

reciprocating said guide members parallel to said winding mandrel axis so that said guide members alternately engage said strands and thereby deflect said strands from said paths for controlling deposition of said strands in side-by-side relationship in successive layers in said package; and contacting said strands by respective guide edge portions of said guide members so located that, transversely of said winding mandrel axis, said guide edge portions are offset towards said winding mandrel from a linearly disposed relationship to intersect said strand paths at respective different angles corresponding to the differences in direction of said strand paths and thereby to compensate for differences in said deflections of said strands by said guide members resulting from the differences in direction of said strand paths and improve said deposition of said strands into said package.

20. A strand guide for guiding an array of convergent strands onto a package build in a multistrand package winding operation; said strand guide comprising:

means defining a pair of strand guide edges;

said strand guide edges being spaced from one another transversely of said strand guide by a strand guide gap for receiving the array of strands; and a support portion of said strand guide supporting said strand guide edge defining means;

said guide support portion defining a support pivot axis extending transversely of said strand guide; and said strand guide edges each being forwardly offset from a straight line by an amount which increases progressively from the bottom to the top of the strand guide edges for at least partially compensating differences in the directions of approach of the strands to said strand guide.

21. A strand guide as claimed in claim 20, wherein said gap is upwardly divergent.

22. A strand guide as claimed in claim 20, wherein said strand edge defining means comprise a pair of upstanding strand guide fingers spaced transversely of said strand guide.

23. A strand guide as claimed in claim 20, wherein said fingers and said gap are upwardly divergent.

24. A strand guide as claimed in claim 20, 21 or 22, wherein said strand guide edges are spaced transversely of said strand guide by a Vee-shaped relative disposition of said strand guide edges.

25. A strand guide as claimed in claim 22 or 23, wherein said fingers are formed with respective first and second package build contact surfaces and said strand guide portion is formed with a third package build contact surface, said first, second and third surfaces facing forwardly from said strand guide for sliding contact with the peripheral surface of the package build.

26. A strand guide as claimed in claim 20, 21 or 22, wherein said guide portion has a part cylindrical recess extending transversely of said strand guide and defining said support pivot axis, said recess being open along one side thereof and said strand guide support portion being resilient to permit snap-on engagement of a support pivot in said recess.

27. A strand guide device for reciprocation by a cam-controlled transverse mechanism of a package winder said strand guide device comprising:

a strand guide for guiding engagement with an array of convergent strands in the vicinity of a package build;

said strand guide comprising a pair of spaced strand guide edges defining a gap for receiving the strands therebetween and spaced package contact surfaces for sliding engagement with the periphery of the package build;

means for mounting said strand guide adjacent the package build;

said mounting means comprising:

a reciprocatable support for connection to a cam follower of the traverse mechanism;

a pivotal support link between said strand guide and said reciprocatable support;

a first pivotal connection between one end of said pivotal support link and said reciprocatable support;

a second pivotal connection between said strand guide and the opposite end of said pivotal support link;

a leaf spring extending from said reciprocatable support so that the outer end of said leaf spring is remote from said reciprocatable support;

a connecting link between said opposite end of said support link and said outer end of said leaf spring;

a third pivotal connection between said connecting link and said opposite end of said support link; and a fourth pivotal connection between said connecting link and said outer end of said leaf spring.

28. A strand guide device as claimed in claim 27, further comprising switch means actuatable by deflection of said leaf spring, in response to pressure of the package build on said guide member, for initiating displacement of said guide member from said package build.

29. A strand guide device as claimed in claim 27, wherein said strand guide comprises a pair of upstanding fingers spaced apart transversely of said strand guide, said strand guide edges being formed on said fingers and said gap being upwardly divergent.

30. A strand guide device as claimed in claim 27, wherein said strand guide edges are each forwardly offset from a straight line by an amount which increases progressively from the bottom to the top of the strand guide edges for at least partially compensating differences in the directions of approach of the strands to said strand guide.

31. A strand guide device as claimed in claim 27, 28 or 29, wherein said second pivotal connection comprises a pivot on said support link and means defining a recess in said strand guide, said recess being part cylindrical and open at one side thereof and said strand guide being resilient to permit snap-on engagement of said pivot in said recess.

* * * * *